US006964443B1

(12) United States Patent
Newton

(10) Patent No.: US 6,964,443 B1
(45) Date of Patent: Nov. 15, 2005

(54) DEVICE FOR HOLDING MULTIPLE BEVERAGE CONTAINERS

(76) Inventor: Edward R. Newton, 276 N. Melanie Ct., Palatine, IL (US) 60067

( * ) Notice: Subject to any disclaimer, the term of this patent is extended or adjusted under 35 U.S.C. 154(b) by 0 days.

(21) Appl. No.: 10/672,355

(22) Filed: Sep. 29, 2003

(51) Int. Cl.[7] ..... A47G 23/06
(52) U.S. Cl. ..... 294/172; 294/159; 206/217
(58) Field of Search ..... 294/159, 172, 294/87.2, 144, 87.28; D7/552.1, 552.2; 206/203, 206/217

(56) References Cited

U.S. PATENT DOCUMENTS 1,305,164 A * 5/1919 Rake ..... 294/159
1,643,735 A * 9/1927 Baker ..... 294/172
1,659,344 A * 2/1928 Wissman ..... 294/159
2,264,903 A * 12/1941 Kruea ..... 294/87.28
2,336,649 A * 12/1943 Sportolari ..... 294/159
2,997,196 A * 8/1961 Emery ..... 206/521.1
3,003,805 A * 10/1961 Glazer ..... 294/87.2
3,036,853 A * 5/1962 Glazer ..... 294/87.2
D227,851 S * 7/1973 Nowland et al. ..... D7/552.1
3,768,710 A * 10/1973 Eggers ..... 294/159
3,951,259 A * 4/1976 Oglesbee ..... 294/159
4,361,263 A * 11/1982 Thomas ..... 206/521.1
5,769,264 A * 6/1998 Lipkowitz ..... 294/144
5,899,515 A * 5/1999 Burns ..... 294/159
5,971,139 A 10/1999 Bradley
5,971,167 A 10/1999 Finbow
6,021,914 A * 2/2000 Schmidt ..... 220/574
6,131,732 A 10/2000 Schneider
6,264,026 B1 * 7/2001 Bradley ..... 206/217
6,520,366 B1 2/2003 Bradley et al.

* cited by examiner

*Primary Examiner*—Eileen D. Lillis
*Assistant Examiner*—Paul T. Chin
(74) *Attorney, Agent, or Firm*—Egbert Law Offices

(57) ABSTRACT

A beverage holding device has a panel with a plurality of slots opening at a peripheral edge thereof and at least one support member extending downwardly from a bottom surface of the panel. Each of the slots has a generally C-shaped configuration and opens to the peripheral edge of the panel. The slots serve to receive drink containers therein. The support member can nest within a support member of an underlying beverage holding device.

4 Claims, 2 Drawing Sheets

DEVICE FOR HOLDING MULTIPLE BEVERAGE CONTAINERS

RELATED U.S. APPLICATIONS

Not applicable.

STATEMENT REGARDING FEDERALLY SPONSORED

RESEARCH OR DEVELOPMENT

Not applicable.

REFERENCE TO MICROFICHE APPENDIX

Not applicable.

FIELD OF THE INVENTION

The present invention relates to beverage holding devices. More particularly, the present invention relates to various types of trays that are used to support a variety of beverages thereon. More particularly, the present invention relates to tray-type devices which display and support a variety of drink containers on a flat surface.

BACKGROUND OF THE INVENTION

It is common practice to deliver drinks to customers by placing a number of drinks on a flat tray. The waiter or waitress can then deliver the drinks to a table by balancing the drinks on the flat tray, placing the flat tray on the table and then removing the drinks. In other circumstances, the waiter or waitress will hand the drinks directly to the customer by lifting the drinks from the tray and handing the drinks to the customers.

In certain restaurants and bars, it is a common practice to provide the customer with flights of scotch. These flights of scotch allow the customer to sample a wide variety of different flavors of scotch. Typically, these flights of scotch will be four or five single once servings of various types of scotch at the same time. In other circumstances, flights of various other drinks, such as wine, vodka and rum, are delivered to the customer so that a customer can taste and compare the varieties of these drinks. The delivery of a variety of flights of a particular drink is becoming an increasingly common practice in restaurants and bars.

Heretofore, it has been exceeding difficult to deliver the flights of the drinks to the various tables. Since a variety of different drinks must be managed and carried to the particular table, the waiter or waitress could often mix up the various types that are to be delivered to the customer. In other circumstances, the drinks will spill as they are being transferred from the tray to the table. In any event, it is quite difficult to keep the drinks organized during the delivery to the table. As such, a need has developed for a particular type of tray or carrying device whereby the individual drinks can be properly organized, delivered, and consumed in a convenient and safe manner.

In the past, various patents have issued for drink carrying and delivering devices. For example, U.S. Pat. No. 5,971,167, issued on Oct. 26, 1999 to D. Finbow, teaches a holder for stemmed drinking vessels. This holder has a base and a bowl connected by a stem. The holder has a support structure and vessel supports are disposed on the support member to support a plurality of vessels with their stems crossed. The support structure is formed symmetrically about an axis to define an interior space for receiving the vessels.

U.S. Pat. No. 5,971,139, issued on Oct. 26, 1999 to V. H. Bradley, teaches a food and beverage tray. This tray includes a plate section that has a planar inner section that is surrounded by a raised lip. A cup holder, for holding a beverage container, is attached to the plate section by an intermediate section. A hand grip extends downwardly from the intermediate section. The hand grip is hollow and provides space for tableware and condiments. The hand grip has a plurality of serrations to facilitate gripping the hand grip. A plurality of supports extend downwardly from the plate section to provide additional support to the plate section when the food and beverage tray is placed upon a supporting surface. The supports are placed apart so as to extend downwardly on opposite sides of a person's arm when the food and beverage tray is held.

U.S. Pat. No. 6,131,732, issued on Oct. 17, 2000 to P. W. Schneider, describes a foam drink tray having improved cup cavities. This tray has a foam base with at least two cup cavities disposed in a top thereof. At least one hand cavity is formed in a top thereof for the retention by a hand. The side wall of each cup cavity is shaped in several different ways. Each side wall surface which contacts the cup or can is chamfered where it meets the top of tray.

U.S. Pat. No. 6,520,366, issued on Feb. 18, 2003 to Bradley et al., teaches a beverage container holder which includes a single-cup beverage container holder, a dual-cup beverage container holder, a three-cup beverage container holder and four-cup beverage container holder. The container holders are characterized by at least one container cup and a handle attached to the container cup. The handle is hollow and serrated to facilitate the non-rotatable nesting of the handles of two or more of the beverage container holders in either a stored or functional configuration. The various configurations of the container cups on the handles facilitate selective positioning of the container cups of multiple nested beverage container holders so as to enable an individual to carry a selected number of beverages using one hand at the nested handles.

It is an object of the present invention to provide a beverage holding device in which flights of an alcoholic beverage to be conveniently and easily carried.

It is another object of the present invention to provide a beverage container holder which can support various beverage containers upon a flat supporting surface.

It is another object of the present invention to provide a beverage container holder which allows a variety of such holders to be stored in a nested condition one upon the other.

It is a further object of the present invention to provide a beverage container holder which allows the flights of the alcoholic beverage to be conveniently and easily displayed and organized.

It is still another object of the present invention to provide a beverage container holder which is easy to use, relatively inexpensive, and easy to manufacture.

These and other objects and advantages of the present invention will become apparent from a reading of the attached specification and appended claims.

BRIEF SUMMARY OF THE INVENTION

The present invention is a beverage container holding device comprising a panel having a peripheral edge with a plurality of slots opening at this peripheral edge. Each of the slots extends inwardly from the peripheral edge.

In the present invention, each of the plurality of slots has a generally C-shaped configuration. Each of the plurality of slots has an opening at the peripheral edge with a width that is less than a diameter of the slot positioned inwardly of the peripheral edge. In the preferred embodiment of the present invention, the peripheral edge is a curved edge. Each of the plurality of slots faces a different directional along this curved edge.

in the present invention, the panel also has a back edge extending between the end of the curved edge. The back edge has an arcuate configuration. The radius of the back edge is greater than the radius of the curved edge. The panel also has a top surface and a bottom surface.

In the present invention, a support element extends downwardly from the bottom surface of the panel. This support element is of a tapered configuration with a diameter at the bottom surface of the panel being greater than a diameter of the support element at the bottom end thereof. In particular, the support element includes a first support member extending downwardly from a central area of the panel, a second support member positioned adjacent an edge of the panel opposite the peripheral edge and extending downwardly from the bottom surface of the panel, and a third support member positioned adjacent an edge of the panel opposite the peripheral edge and extending downwardly from the bottom surface of the panel. The second support member is positioned on a side of the first support member opposite the third support member. Each of the first support member, the second support member and the third support member are tapered so as to have a wide diameter at the bottom surface of the panel and a narrow diameter at the bottom end of the support member. Each of the support members is a hollow tubular member with an upper end opening at the top surface of the panel. In the preferred embodiment of the present invention, the second support member and the third support member have a generally oval cross section. The first support member has a generally circular cross section.

In the preferred embodiment of the present invention, the plurality of slots comprise at least four slots each opening at different locations along the peripheral edge of the panel. The panel can be integrally formed of a polymeric material. The back edge is the surface suitable for gripping by the waiter or waitress. The various flights of alcoholic beverages can be simply placed into the plurality of slots that open at the peripheral edge of the panel.

DETAILED DESCRIPTION OF THE INVENTION

Figure 1:
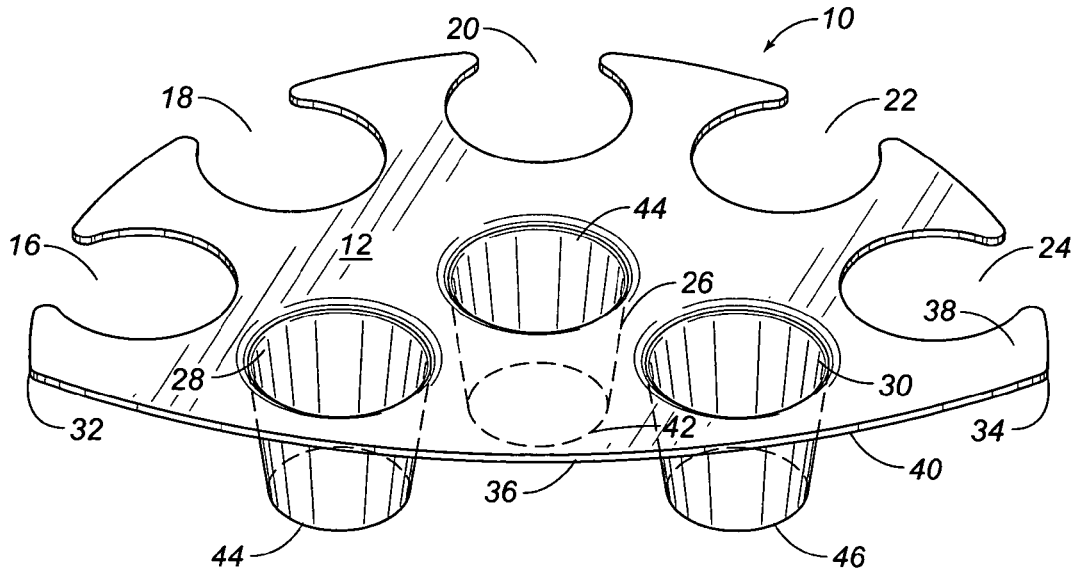
FIG. 1 is a perspective view showing the beverage container holder of the present invention.

Referring to FIG. 1, there is shown the beverage container holder 10 in accordance with the preferred embodiment of the present invention. The beverage container holder 10 includes a panel 12 having a peripheral edge 14. The panel includes a plurality of slots 16, 18, 20, 22 and 24 opening at the peripheral edge 14. As can be seen in FIG. 1, each of the plurality of slots 16, 18,20,22 and 24 extends inwardly from the peripheral edge 14. A first support element 26 is formed in the panel 12 and extends downwardly therefrom. A second support element 28 and a third support element 30 are also formed in the device 10 so as to extend downwardly from panel 12.

As can be seen in FIG. 1, each of the plurality of slots 16, 18, 20, 22 and 24 has a generally C-shaped configuration. Each of these plurality of slots 16, 18, 20, 22 and 24 has a generally circular configuration with an opening at the peripheral edge 14. The opening at the peripheral edge 14 has a width that is less than a diameter of each of the slots 16, 18, 20, 22 and 24 inwardly of the opening. The peripheral edge 14 is curved from end 32 to end 34. Each of the slots 16, 18, 20,22 and 24 faces in different directions along the curved surface of the peripheral edge 14. A back edge 36 of panel 12 extends between the ends 32 and 34 of the curved peripheral edge 14. This back edge 36 has an arcuate configuration. The radius of the back edge 36 will be greater than the radius of the curved peripheral edge 14.

The panel 12 has a top surface 38. As can be seen in FIG. 1, the term "CLASSIC MALTS" appears on the top surface 38. As such, there is an area formed on the top surface 38 of panel 12 that can be used for various types of indicia, such as advertisements, identification information, and other displays. In certain circumstances, when flights of an alcoholic beverage are placed within each of the slots 16, 18, 20, 22 and 24, then the top surface 38 can also include information which identifies the particular type of alcoholic beverage that would appear in each of the respective slots 16, 18, 20, 22 and 24.

Figure 3:
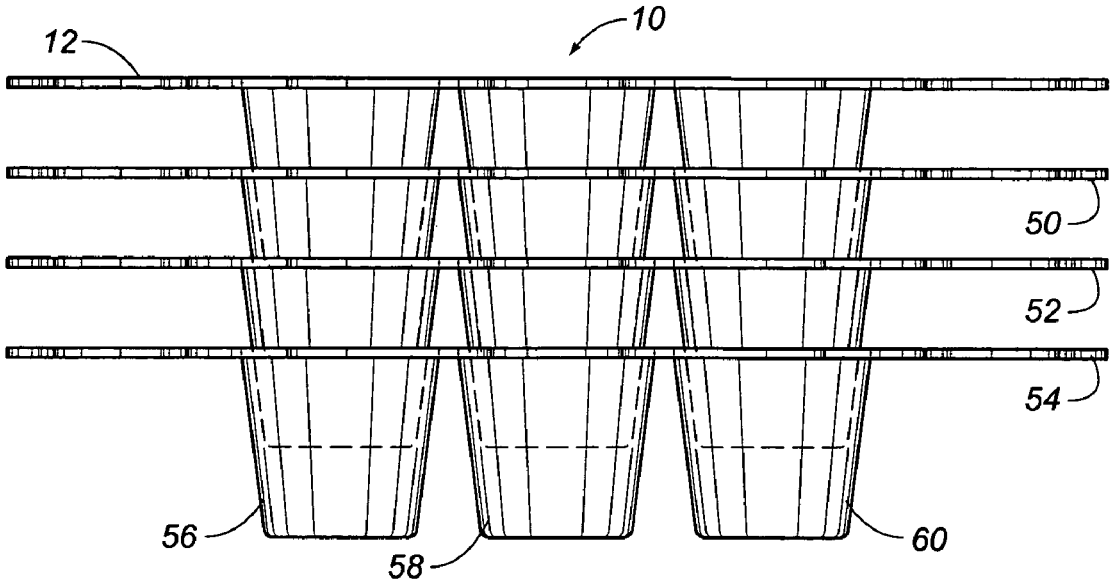
FIG. 3 is a side elevational view showing the manner in which several of the beverage container holders of the present invention can be nested one upon the other.

In FIG. 3, it can be seen that the support member 26 is a support element which extends downwardly from the bottom surface 40 of the panel 12. This downward extension is shown in broken line fashion in FIG. 1. The support member 26 is generally formed centrally of the panel 12. The support member 26 will also have a tapered configuration with a diameter at the bottom surface 40 of the panel having a greater diameter than the diameter of the support member 26 at the bottom end 42 thereof. In particular, it can be seen that the support member 26 is a hollow tubular member having an upper end 44 which opens at the top surface 38 of panel 12. The tapered configuration of the support member 26 allows the stacking of one device 10 upon another device (as illustrated in FIG. 3). The support member 26 has generally circular cross section.

Support members 28 and 30 are positioned adjacent to the arcuate back edge 36 of panel 12. Support member 28 has a generally oval cross section and is positioned adjacent to the back edge 36 on one side of the support member 26. The support member 30 is positioned on an opposite side of the support member 26 from the support member 28. Support member 30 also has a generally oval cross section. Each of the support members 28 and 30 is also tapered downwardly from the bottom surface 40 of the panel 12 to the respective bottoms 44 and 46 thereof. This also allows the support members 28 and 30 to be nested within an underlying respective support member so that the device 10 can be suitably stacked one upon the other.

Figure 2:
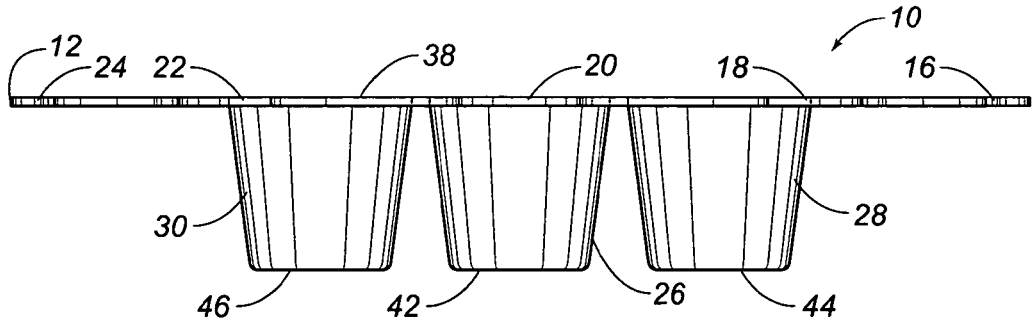
FIG. 2 is a side elevational view of the beverage container holder of the present invention.

FIG. 2 shows a frontal view of the device 10 of the present invention. In particular, it can be seen that the support member 26 has a bottom end 42 in coplanar relationship with the respective bottom ends 44 and 46 of support members 28 and 30. It can also be seen that the support member 26, 28 and 30 are each tapered downwardly from the bottom surface 40 of the panel 12. Each of the support members 26, 28 and 30 will open at the top surface 38 of panel 12.

FIG. 3 shows how the panel 12 of the device 10 can be arranged in a stacked configuration over panels 50,52 and 54. Panel 54 includes support members 56,58 and 60 extending downwardly therefrom. Each of the panels 12, 50, 52 and 54 is of an identical configuration. It can be seen how the support members 26, 28 and 30 will nest within the respective support members of the respective underlying panels 50, 52 and 54. As a result, the present invention allows a large number of devices 10 to be easily stored, transported, and displayed.

Figure 4:
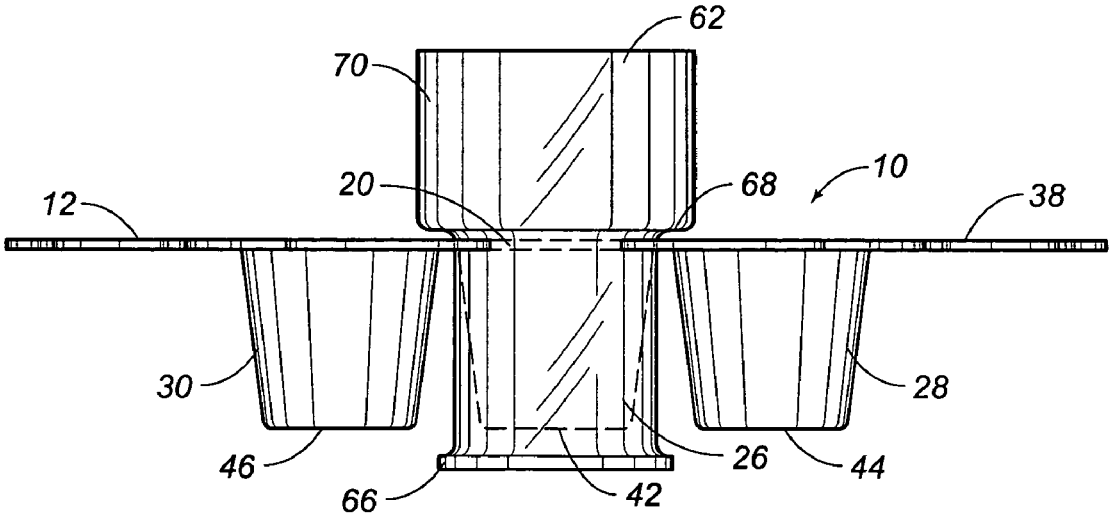
FIG. 4 is a frontal view showing the beverage container holder of the present invention receiving a beverage container therein.

In FIG. 4, it can be seen how the device 10 serves to receive a beverage container 62. The stem 64 of beverage container 62 will be received within the slot 20 of panel 12. The stem 64 is generally freely received within the slot 20. As a result, if the stem 64 would extend too far downwardly from the bottom surface 40 of panel 12, the panel 12 will move downwardly along the stem 64 so that the bottom 42 of the support member 26 will reside in coplanar relationship with the base 66 of the container 62. When the panel 12 is lifted, the top surface 38 of panel 12 will come into contact with the underside 68 of the bowl 70 of beverage container 62. As a result, the beverage container 62 can be easily lifted by the device 10. When the device 10 is transported to a table and placed on the top surface of the table, the bottoms 44 and 46 of support members 28 and 30, respectively, will lie in surface-to-surface contact with the supporting surface. Similarly, the base 66 of beverage container 62 will reside in such surface-to-surface contact with the supporting surface. As a result, beverage container 62, along with any other beverage containers that are received within the respective slots 16, 18, 20, 22 and 24, can also be placed in a desired position on the table.

On the other hand, if the stem 64 of beverage container 62 is very short, then the support members 26,28 and 30 will still maintain the beverage container 62 in an upright configuration with the bottom of the beverage container 62 spaced from the underlying support surface. It is only necessary to slightly lift and slide the beverage container 62 from the panel 12 so as to remove the beverage container. As a result, the present invention keeps the beverage container in an ideal position for delivery and use. The emptied beverage container can be returned to the slot 20 or any of the other slots, so that the device 10 can be returned to the bar for refilling or for washing. Since the device 10 is formed of an inexpensive polymeric material, the device 10 of the present invention is relatively inexpensive.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A beverage holding device comprising:

a panel having a peripheral edge, said panel having at least four slots opening at a curved front edge, each of the slots extending inwardly from said front edge, each of the slots having a generally C-shaped configuration, each of the slots having an opening at said front edge having a width that is less than a diameter of said slot inwardly of said opening, said panel having continuously curved back edge extending between ends of said front edge, a radius of said back edge being greater than a radius of said front edge; and a plurality of support elements extending downwardly from a bottom surface of said panel, each of said plurality of support elements being of a hollow tapered configuration with a diameter at said bottom surface of said panel being greater than a diameter of the support element at a bottom end of said support element, each of said plurality of support elements being open at said panel and being closed at the bottom of the support element, the bottoms of said plurality of support elements being coplanar and in plane parallel relation to said panel.

2. The device of claim 1, each of said plurality of slots facing different directions along said front edge.

3. The device of claim 1, said support elements comprising:

a first support member extending downwardly from a central area of said panel;

a second support member positioned adjacent said back edge of said panel and extending downwardly from said bottom surface of said panel; and a third support member positioned adjacent said back edge of said panel and extending downwardly from said bottom surface of said panel.

4. The device of claim 3, said second support member being positioned on a side of said first support member opposite said third support member.

* * * * *